US010271665B1

(12) United States Patent
Tito et al.

(10) Patent No.: US 10,271,665 B1
(45) Date of Patent: Apr. 30, 2019

(54) BACKPACK WITH PROTECTIVE SHELL FOR SAFELY TRANSPORTING A CHILD

(71) Applicant: Teresa M. Tito, Napa, CA (US)

(72) Inventors: Teresa M. Tito, Napa, CA (US); Kenneth A. Gross, Porter Ranch, CA (US); James M. Ibon, Porter Ranch, CA (US); Martin H Dalgaard, Topanga, CA (US); Michael I. Fineberg, Santa Clarita, CA (US)

(73) Assignee: Teresa M. Tito, Napa, CA (US)

( * ) Notice: Subject to any disclaimer, the term of this patent is extended or adjusted under 35 U.S.C. 154(b) by 0 days.

(21) Appl. No.: 15/655,910

(22) Filed: Jul. 21, 2017

(51) Int. Cl.
*A47D 15/00* (2006.01)
*A47D 13/02* (2006.01)

(52) U.S. Cl.
CPC ..... *A47D 15/006* (2013.01); *A47D 13/025* (2013.01)

(58) Field of Classification Search
CPC ..... A47D 13/02; A47D 13/025; A47D 15/006
USPC ..... 224/161
See application file for complete search history.

(56) References Cited

U.S. PATENT DOCUMENTS 3,799,414 A 3/1974 Filler
4,620,711 A * 11/1986 Dick ..... B60N 2/2848 224/153
4,915,401 A 4/1990 Severson et al.
5,431,478 A * 7/1995 Noonan ..... A47D 13/025 297/130
5,515,546 A * 5/1996 Shifrin ..... A42B 3/00 2/209.11
5,678,739 A 10/1997 Darling et al.
5,711,466 A * 1/1998 Kataoka ..... A47D 13/025 224/159
5,987,665 A 11/1999 Simantob et al.
6,098,857 A * 8/2000 Le Gal ..... A47D 13/025 224/153
6,223,749 B1 5/2001 Beaty
6,471,105 B1 10/2002 Ammerman et al.
6,672,493 B1 1/2004 Fair et al.
6,837,409 B2 * 1/2005 Lemanski, II ..... A45F 3/04 224/578
7,168,600 B2 1/2007 Hwang
7,484,645 B2 2/2009 Hoff et al.
7,517,011 B2 4/2009 Aliev
7,862,115 B1 1/2011 Davis
3,028,871 A1 10/2011 Gray
8,182,033 B2 5/2012 Hei et al.
8,393,505 B2 3/2013 Coote
8,590,757 B2 11/2013 Frost
8,916,742 B2 12/2014 Smith
8,960,794 B2 2/2015 St. Pierre
(Continued)

*Primary Examiner* — Derek J Battisti
(74) *Attorney, Agent, or Firm* — File-EE-Patents.com; Jay A. Chesavage

(57) ABSTRACT

A protective child carrier has an upper shell having a rigid outer surface and an expanded foam inner surface, the lower part of which is coupled to a lower shell also having a rigid outer surface and expanded foam inner surface. The upper shell and lower shell joined with an articulating fabric joint, the upper shell and lower shell attached to a semi-rigid back support at the top using removable fabric sidewalls which have removable attachments at the semi-rigid back support, and are attached to the semi-rigid back supports. The semi-rigid back support has shoulder pads attached at the top and bottom of the rigid back support.

14 Claims, 4 Drawing Sheets

(56) References Cited

U.S. PATENT DOCUMENTS

| | | | | |
|---|---|---|---|---|
| 9,179,758 | B2 | 11/2015 | Calilung et al. | |
| 9,314,112 | B2 | 4/2016 | Chuah | |
| 9,375,096 | B2 * | 6/2016 | Larch | A47D 13/025 |
| 9,380,887 | B2 | 7/2016 | Frost | |
| 9,380,888 | B2 | 7/2016 | Telford et al. | |
| 9,415,844 | B2 | 8/2016 | Williams et al. | |
| 2006/0138826 | A1 * | 6/2006 | Caton | A47D 13/02 297/256.16 |
| 2007/0283496 | A1 * | 12/2007 | Skripps | A61G 7/05738 5/654 |
| 2009/0236380 | A1 * | 9/2009 | Adkins | A61G 1/04 224/161 |
| 2013/0076084 | A1 * | 3/2013 | Ho | A47D 13/025 297/183.6 |
| 2014/0292049 | A1 * | 10/2014 | St. Pierre | A47D 13/02 297/256.16 |
| 2016/0157638 | A1 * | 6/2016 | Waters | A47G 9/0223 5/482 |

* cited by examiner

Section A–A

Section A–A

Section B–B

Gel Pad

Section C–C

Gel Pad

Section D–D

BACKPACK WITH PROTECTIVE SHELL FOR SAFELY TRANSPORTING A CHILD

FIELD OF THE INVENTION

The present invention relates to a carrier for a child. In particular, the invention relates to a protective carrier for protection of the child against impacts from the wearer of the backpack falling.

BACKGROUND OF THE INVENTION

A backpack for transporting a child typically provide support for the child and provide comfort for the wearer, but often does not provide impact protection for the child to prevent injury if the wearer should trip or fall. In particular, prior art backpacks typically do not provide protection for the child's head and delicate cranium in the event the wearer trips, falls, or loses balance and collides with a standing object, causing a greater and potentially more traumatic injury than would otherwise be possible without the child being transported in a backpack.

It is desired to provide an improved backpack for safely transporting a child which provides support and protection for a child's cranium and body, reducing likelihood of injury to the child from a fall or collision with a stationary object by the wearer of the backpack.

Objects of the Invention

A first object of the invention is a protective child carrier having:

a back support and shoulder straps, the back support conformable to a wearer's back, the back support having attachments for supporting:

a lower shell comprising a rigid convex outer surface and an expanded foam concave inner surface;

a concave upper shell comprising a convex rigid outer surface and an expanded foam concave inner surface;

the back support having side curtains supporting the upper sides of the upper shell;

the upper shell having a lower part with a flexible hinged connection to the lower shell upper part.

A second object of the invention is a protective child carrier having:

a support structure including shoulder straps on a front surface and attachments to a child carrier on a rear surface, the child carrier having a lower shell comprising a convex rigid outer surface and an expanded foam concave inner surface, an upper shell comprising a convex rigid outer surface and an expanded foam concave inner surface, the back support having side curtains supporting the upper sides of the concave upper shell from moving backwards beyond a riding position, the side curtains attached to the back support with removable attachments.

A third object of the invention is a protective carrier for a child, the carrier having an upper shell and a lower shell connected with a fabric hinge, the upper shell and lower shell each comprising a rigid outer surface and an expanded foam inner surface, the expanded foam being at least twice as thick as the rigid outer surface, the upper shell and lower shell attached to a back support using removable side curtains and a lower attachment part of the lower shell, the lower shell optionally having a set of support legs for maintaining an upright position of the child carrier.

A fourth object of the invention is a protective child carrier comprising an upper shell and a lower shell, the upper shell and lower shell having an impact resistant upper outer surface which resists deflection from contact forces, the upper shell and lower shell having an expanded foam inner surface which crushes upon application of a sufficiently high force to protect a child in the protective carrier upper shell and lower shell when a sufficient force develops between the child and the outer surface of the upper shell or lower shell;

SUMMARY OF THE INVENTION

The present child carrier provides protection from cranial injuries, concussions, and other brain injuries caused by sudden deceleration events, such as those caused by the wearer falling or a child carrier striking stationary objects while a child is being transported in the protective carrier. The child carrier has an upper convex outer shell and a lower convex outer shell which are formed from an impact-resistant material which prevents sharp objects from penetrating the outer shell, and also spreads point impact forces to a wider area surrounding the point of impact. Each of the upper and lower convex shells includes are adjacent to an inner concave compressible material which provides deceleration of the child upon impact to the outer shell. The upper convex outer shell and lower convex outer shell are attached to the opposite surface of a conformable back support with arm loops and optional belt provided for comfort of the wearer of the backpack. A hinge is formed between the upper convex outer shell and lower convex outer shell from a material such as thick fabric, which provides for preferential rotational movement between the upper outer shell and lower outer shell about a single axis compared to other orthogonal axes, and allows for the upper shell to be moved away from the back support or towards the back support for ease of placement and removal of the child to the carrier. The thick fabric hinge rotates on one common axis between the upper convex outer shell and lower convex outer shell, but prevents rotation or twisting between the upper convex outer shell and lower convex outer shell in any other axis orthogonal or perpendicular to the common axis. An optional detachable fabric web connects the upper outer shell and lower outer shell for additional support and to limit the range of motion of the fabric hinge. The upper outer shell and lower outer shell are attached to a backpack frame with shoulder straps and optional belt strap for a wearer, as is known in the prior art.

DETAILED DESCRIPTION OF THE INVENTION

Figures 1, 2:
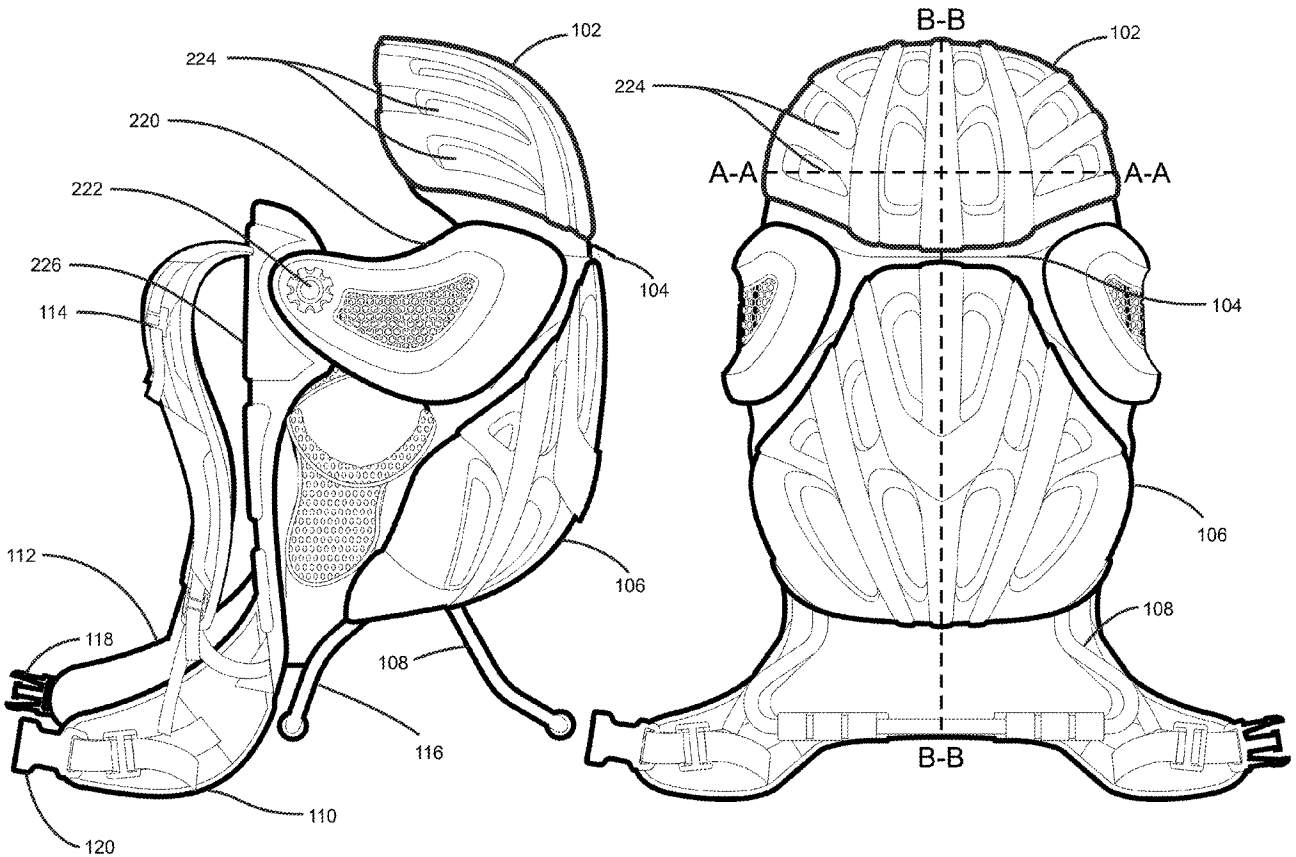
FIG. 1 shows a side view of a protective child carrier.
FIG. 2 shows a rear view of a protective child carrier.

FIGS. 1 and 2 show side and back views, respectively, of a protective child carrier according to an embodiment of the present invention. Reference numbers for each feature may accordingly be examined in these two views. An upper shell 102 and lower shell 106 are separately formed and have a hinge joint 104 which joins the lower part of upper shell 102 and upper part of lower shell 106, where the hinge may be formed from a wide piece of fabric which spans the width of the upper shell and lower shell at the hinge point. Alternatively, the hinge may be formed from interlocking fingers or a hinge point formed directly onto the upper shell and lower shell at the point of intersection between the lower region of the upper shell and the upper region of the lower shell. The hinge joint 104 acts to allow the upper shell 102 to rotate principally with respect to the lower shell 106 on a hinge axis only, providing resistance against rotation in any axis perpendicular to the hinge axis. This prevents a carried child's upper body supported by the upper shell from rotating in a different direction than the lower shell, thereby protecting the spine of the carried infant from overextension. The hinge also acts to prevent the upper shell from rotating to the left or right with respect to the lower shell.

The upper shell 102 and lower shell 106 have impact resistant outer surfaces which are sufficient to prevent penetration from hazardous stationary objects such as masonry corners, curbs, rocks, or other hazards which may be encountered during or after a fall or loss of balance by a wearer of the protective child carrier. The protective outer shell also acts to spread impacts from sharp or pointed objects during a collision to surrounding outer shell areas.

Figure 5A:
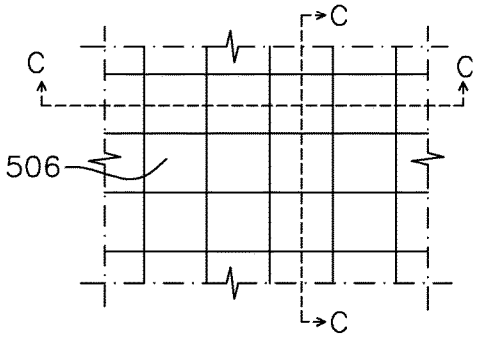
FIGS. 5A and 5C show a plan view of a conformable gel protective pad.
Figure 5B:
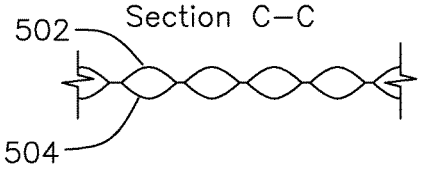
FIGS. 5B and 5D show section views of the gel protective pads of FIGS. 5A and 5C, respectively.
Figure 5C:
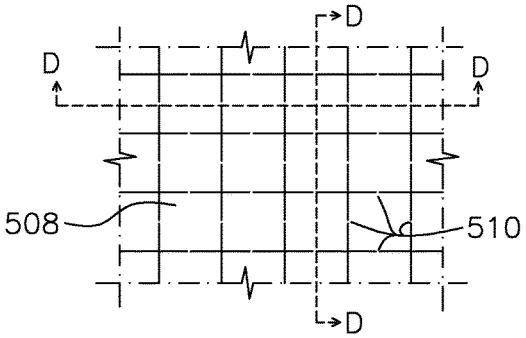
Figure 5D:
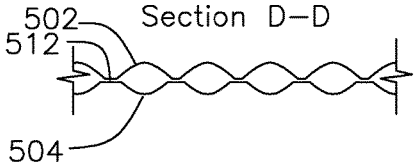

The upper shell 102 and lower shell 106 have a convex inner surface formed by an expanded foam, typically in the range of ½" to 1" in thickness, although the foam may be of greater or lesser thickness. The inner surface may be formed integral to the outer shell, or it may be a removable inner liner. The inner surface acts in concert with the outer shell, spreading an external impact force to a small region of the outer shell to a wider area for absorption by the compressible inner liner. In particular, the expanded foam may be non-linear in deflection vs force, and is selected to provide minimal deflection until an impact event occurs. Example protective foams which this property include expanded polystyrene (EPS) foam, which has desirable compression properties upon impact, and is preferred for ease of molding. In another example of the invention, the inner liner is formed from a natural material such as soy based open cell foam or expanded cork which have desired impact-absorbing compression characteristics. Alternatively, the compressible inner liner may be formed from a compressible gel pad as shown in related FIGS. 5A, 5B, 5C, and 5D. FIG. 5A shows a gel pad formed from an upper membrane 502 and lower membrane 504 such as urethane which is welded or otherwise formed into a regular or irregular array, thereby forming a series of conformable compartments 506 filled with a fluid such as a gel or air. The upper membrane 502 and lower membrane 504 may be formed of any comfortable non-allergenic material, including fabric-lined urethane, or a conformable barrier material which may be placed between the membrane material and a surface which may come in contact with the carried child. In another example of the invention shown in FIG. 5C, the compartments 508 are arranged in a regular or irregular array using a top membrane 502 and bottom membrane 504, where the top and bottom membranes include interconnecting apertures 512 which provide for the movement of fluid (air or liquid) from one compartment to an adjacent compartment. In this manner, the compartments may slowly change volume to provide a comfortable fit during a stationary interval, and upon impact, provide restricted flow rate to provide deflection during an impact interval.

The outer shell is selected to provide non-compressible rigid characteristics and to prevent intrusion of a hazard which strikes the outer shell from intruding into the protective inner surface or other space occupied by the child being transported. Example outer shell materials include polycarbonate, polyethylene, and carbon fiber, or a thermo-formed bioplastic, any of which may optionally be covered with an external material such as organic wool or other conformable material. In a preferred embodiment as shown, the outer shell and inner surface expanded foam are not continuous surfaces, but instead the outer shell and protective inner surface both provide a series of matching apertures such as 224 for air circulation and cooling to the carried child.

The upper shell 102 and lower shell 106 are attached to a support frame 226 such as by removable side curtains 220, which are attached to a semi-rigid wearer back support 226 by removable attachment 222, which may be a button and aperture or other positive attachment which unambiguously connects side curtain 220 to back support 226 for placing and removing the child into the support. The side curtains 220 may be formed from a conformable, semi-rigid, or rigid material in various applications and embodiments.

Shoulder straps 114 are attached to an upper region of back support 226, and optionally to either support belts 110 and 112 which are attached to back support 222, or to a lower region of back support 226. Belt closures or latches 118 and 120 may be placed at belt ends 112 and 110.

Optional support feet 116 and 108 are attached to lower support 106 and provide a stable upright position for supporting the upper shell and lower shell during the interval the child is being placed in or removed from the carrier. In one example embodiment, the support legs 116 and 108 are formed to have a rotating joint where they join lower shell 106, which provides for the support legs 116 to be moved toward the back support 226, or away from the back support.

Other optional features include belt engagements and padding for wearer comfort, storage compartments which may be placed external to the upper shell or lower shell, or outer pockets formed into the shell material or which may be formed from a material such as fabric and attached to the shell.

Figure 3A:
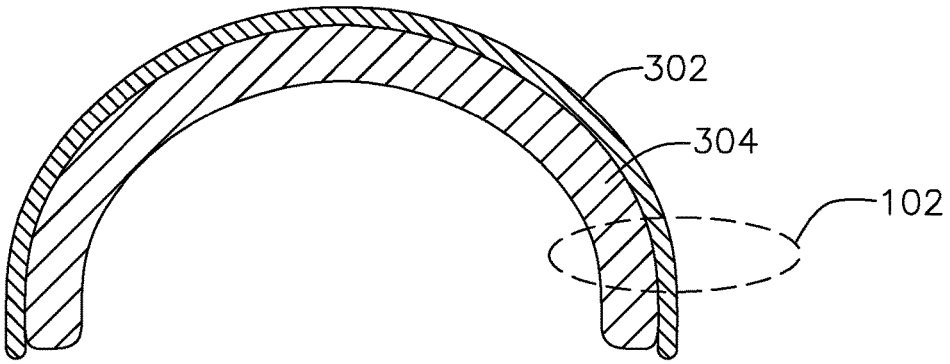
FIGS. 3A and 3B show a cross section view of FIG. 2.
Figure 3B:
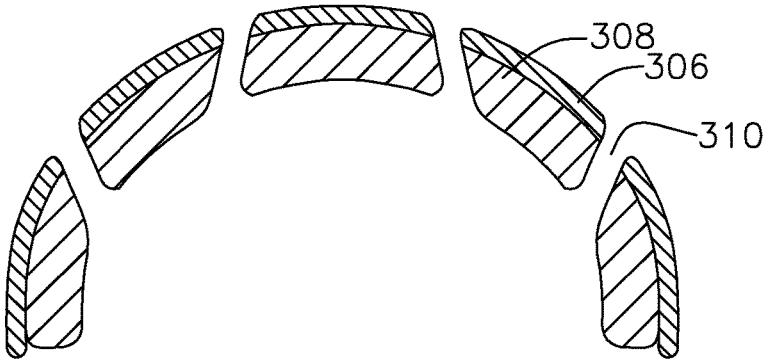
Figure 4:
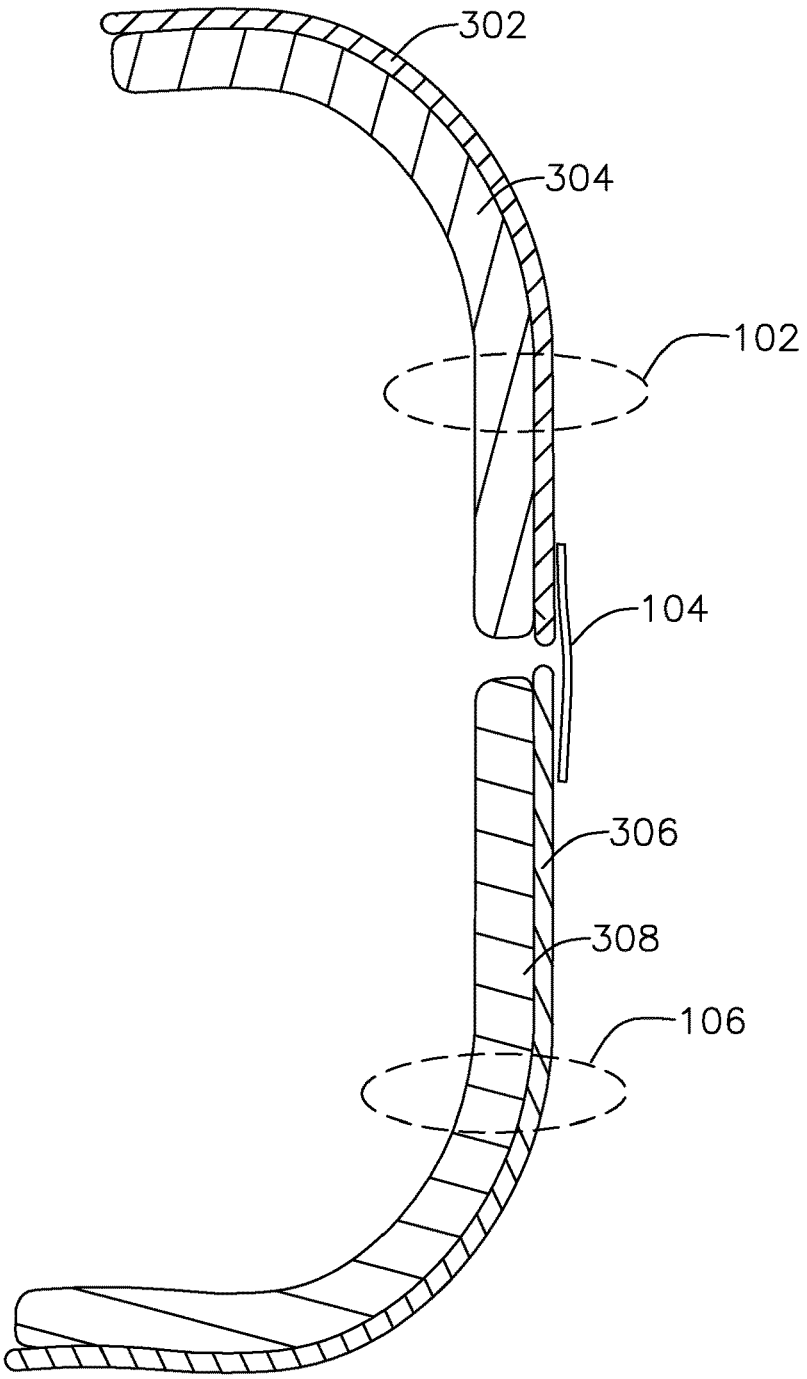
FIG. 4 shows a second cross section view of FIG. 2.

FIG. 2 shows dashed section lines A-A corresponding to FIGS. 3A and 3B, and dashed section lines B-B, corresponding to the section views shown in FIG. 4. FIG. 3A shows cross section A-A for a solid shell 102 in the area surrounding a child's head, with outer convex outer shell 302 which is semi-rigid, and inner concave shell 304 which is compressible. FIG. 3B shows another embodiment of the invention, where outer convex shell 302 and inner concave shell 304 have matching apertures 310 for the circulation of air. Apertures 310 may be of any shape, aspect ratio, or size, but are preferably chosen to prevent an impact or sharp edge from penetrating into the protected area of compressible foam inner shell 304.

FIG. 4 shows a cross section view B-B of FIG. 2, showing upper shell 102 with outer shell 302, inner shell 304, and lower shell 106 with outer shell 306, inner shell 308, and hinge connection 104, which may be formed from a comparatively flexible material such as multiple fabric layers attached to upper outer shell 302 and lower outer shell 306 providing for rotation in an axis which is perpendicular to the plane of section B-B.

We claim:

1. A protective child carrier comprising:

an upper shell having a rigid outer surface and an expanded foam inner surface having an extent sufficient to support the head of a child being carried;

a lower shell having a rigid outer surface and an expanded foam inner surface for supporting a lower body extent below the head of a child being carried;

an articulating joint coupling the bottom section of the upper shell to the upper section of the lower shell;

a back support coupled to the upper shell through removable side curtains, the removable side curtains limiting the range of motion of the articulating joint when in place;

shoulder straps coupled from the top of the back support to the bottom of the back support;

the shell rigid outer surface being thinner than the thickness of the expanded foam inner surface.

2. The protective child carrier of claim 1 where the expanded foam is expanded polystyrene.

3. The protective child carrier of claim 1 where the expanded foam includes a segmented gel pad.

4. The protective child carrier of claim 1 where the shell rigid outer surface is formed from a mixture of resin and glass fibers.

5. The protective child carrier of claim 1 where the shell rigid outer surface if formed from polycarbonate.

6. The protective child carrier of claim 1 where the shell rigid outer surface is formed from polypropylene.

7. The protective child carrier of claim 1 where the shell rigid outer surface is formed from carbon fiber.

8. The protective child carrier of claim 1 where the side curtains include a removable fastener.

9. The protective child carrier of claim 1 where the articulating joint is a fabric bridge separating the upper shell and the lower shell.

10. A protective child carrier comprising:

an upper shell coupled to a lower shell with a fabric joint;

the upper shell having an extent to support a head of a child being carried;

the upper shell having an impact resistant outer surface and an expanded foam inner surface, the upper shell having a plurality of apertures for the movement of air from the outer surface to the inner surface;

the lower shell having an extent to support a region below a head of a child being carried, the lower shell having an impact resistant outer surface and an expanded foam inner surface, the lower shell having a plurality of apertures for the movement of air from the outer surface to the inner surface;

a back support having shoulder straps, the back support coupled to the lower shell with removable flexible side curtains, the removable flexible side curtains thereby allowing the upper shell to articulate away from the back support using the fabric joint for placing or removing a child from the protective child carrier.

11. The protective child carrier of claim 10 where said impact resistant outer surface is at least one of: fiberglass resin mixed with glass fiber, polyethylene, polypropylene, or carbon fiber.

12. The protective child carrier of claim 10 where said expanded foam is expanded polystyrene foam.

13. The protective child carrier of claim 10 where said upper shell side curtains are removable and have an aperture which is operative on a flanged surface of the back support.

14. The protective child carrier of claim 10 where the expanded foam includes a segmented gel pad.

* * * * *